United States Patent [19]

Wilkinson

[11] Patent Number: 5,069,444

[45] Date of Patent: Dec. 3, 1991

[54] DEVICE FOR SIMULATING CLIMBING

[76] Inventor: William T. Wilkinson, Old Meadow Rd., Rte. 4, Box 205, Seaford, Del. 19973

[21] Appl. No.: 425,040

[22] Filed: Oct. 23, 1989

[51] Int. Cl.[5] ..... A63B 23/04

[52] U.S. Cl. ..... 272/70; 182/124; 182/184

[58] Field of Search ..... 272/70, 119, 94, 96, 272/DIG. 4, 131; 182/124, 126, 166, 184; 248/355

[56] References Cited

U.S. PATENT DOCUMENTS 1,576,625 3/1926 Blodgett ..... 182/166
3,071,204 1/1963 Piltingsrud ..... 182/184
4,340,218 7/1982 Wilkinson ..... 272/70
4,648,593 3/1987 Wilkinson ..... 272/70

FOREIGN PATENT DOCUMENTS 0643971 2/1964 France ..... 182/124

*Primary Examiner*—Stephen R. Crow
*Attorney, Agent, or Firm*—Connolly & Hutz

[57] ABSTRACT

A device for simulating climbing includes a pair of side frames each of which has a pair of upper legs into which a pair of lower legs are telescoped. A horizontal platform is connected to the upper legs whereby the effective height of the platform may be adjusted by the degree of telescoping of the lower legs into the upper legs.

8 Claims, 5 Drawing Sheets

DEVICE FOR SIMULATING CLIMBING

BACKGROUND OF INVENTION

There is a growing trend for health awareness. This awareness has led to various approaches for different types of exercise. A particularly superior type of exercise which has been recognized in recent times is climbing. In my U.S. Pat. Nos. 4,340,218; 4,561,652; 4,659,075; and 4,648,593 I have disclosed various approaches for achieving the simulation of climbing. In general, these approaches involve the use of a platform which functions as a single step whereby the user may repeatedly step up and step down from the platform in an exercise program. One of the advantages of such an exercise program would be the capability of adjusting the height of the platform so as to control the degree to which the user must step up and down. For example, in a progressive program a relative low height may be initially used and then the height could be gradually increased. The height adjustability would also be desirable to render the device usable for different size persons.

SUMMARY OF INVENTION

An object of this invention is to provide an exercise device for simulating climbing of the type disclosed in my prior patents wherein height adjustability is conveniently obtained.

A further object of this invention is to provide such a device which may be stored and transported in a compact condition.

In accordance with this invention, the device for simulation of climbing includes a pair of side frames. Each side frame comprises a pair of upper legs hinged together at their upper ends. A lower leg is telescoped into each respective upper leg. A horizontal platform is connected to the upper legs so that the effective height of the platform can be adjusted by the degree to which the lower legs are telescoped into the upper legs.

In a preferred practice of this invention, the telescoping action is controlled by the use of resiliently mounted pins in each lower leg for selectively being engaged in one of a series of openings in each upper leg The openings in the upper legs are arranged to form sets of four openings with one opening from each of the legs being in a set.

In accordance with a preferred practice of this invention springs are mounted in the upper legs and react against the lower legs to urge the platform upwardly with the degree of platform movement being controlled by forming the openings as elongated slots whereby the upper edge of each slot acts as a stop for limiting the upward movement of the platform. In use, the user would step on the platform to urge the platform downwardly against the resilient force of the springs.

In the preferred practice of the invention, the device may be disposed in a collapsed compact condition for easy storage and traveling

THE DRAWINGS

DETAILED DESCRIPTION

Figure 3:
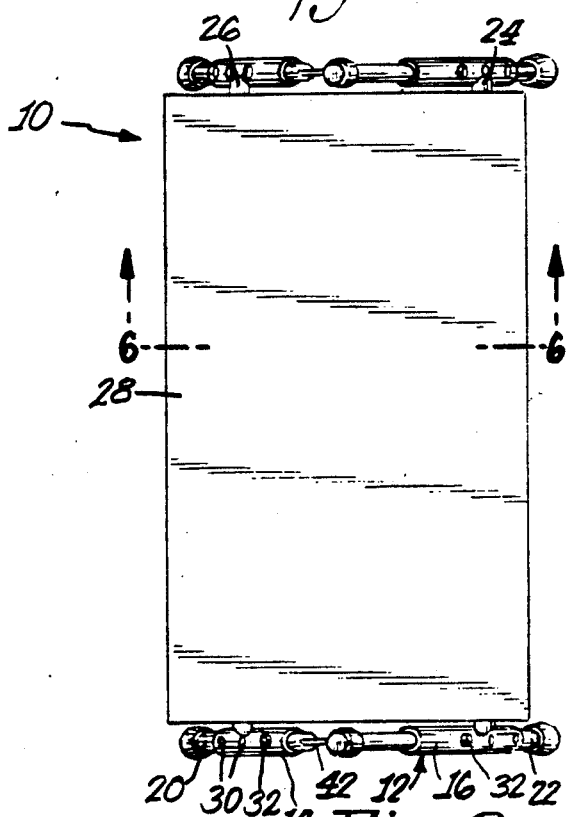
FIG. 3 is a top plan view of the device of FIGS. 1–2.
Figure 1:
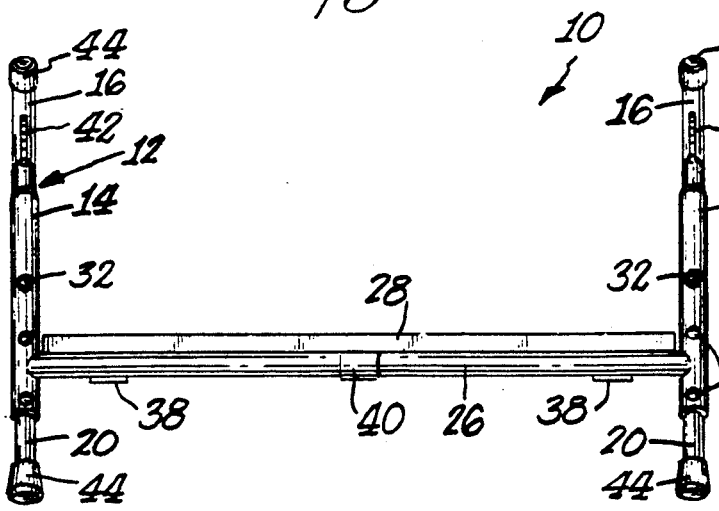
FIG. 1 is a front elevation view of a device for simulating climbing in accordance with this invention.
Figure 2:
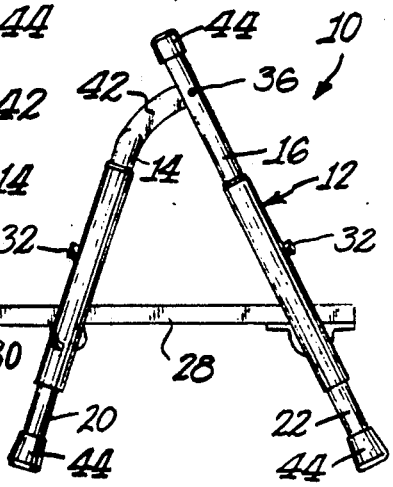
FIG. 2 is a side elevation view of the device of FIG. 1.
Figure 4:
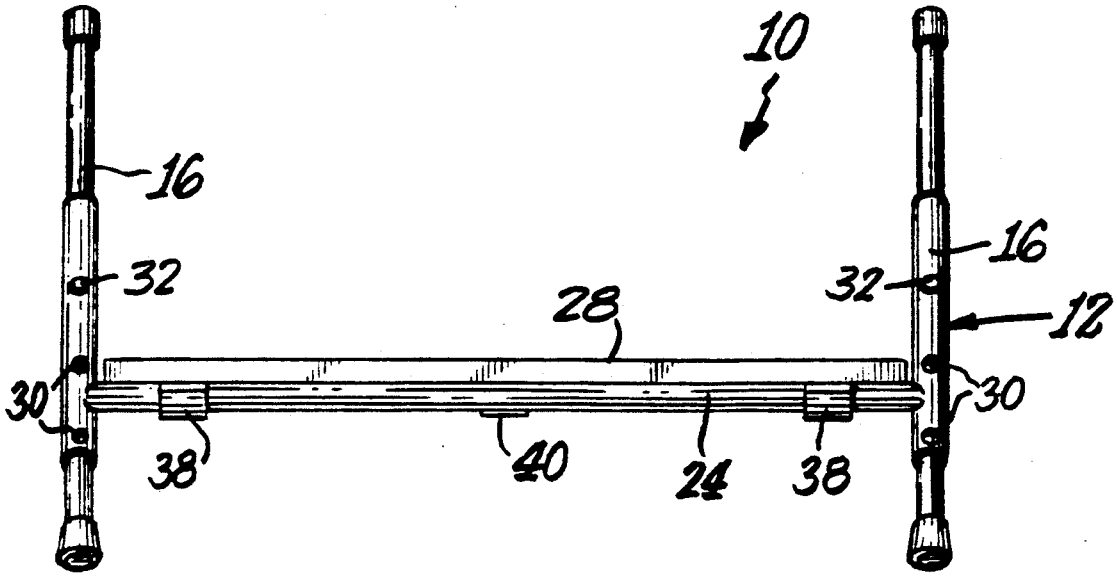
FIG. 4 is a rear elevation view of the device of FIGS. 1–3.
Figure 5:
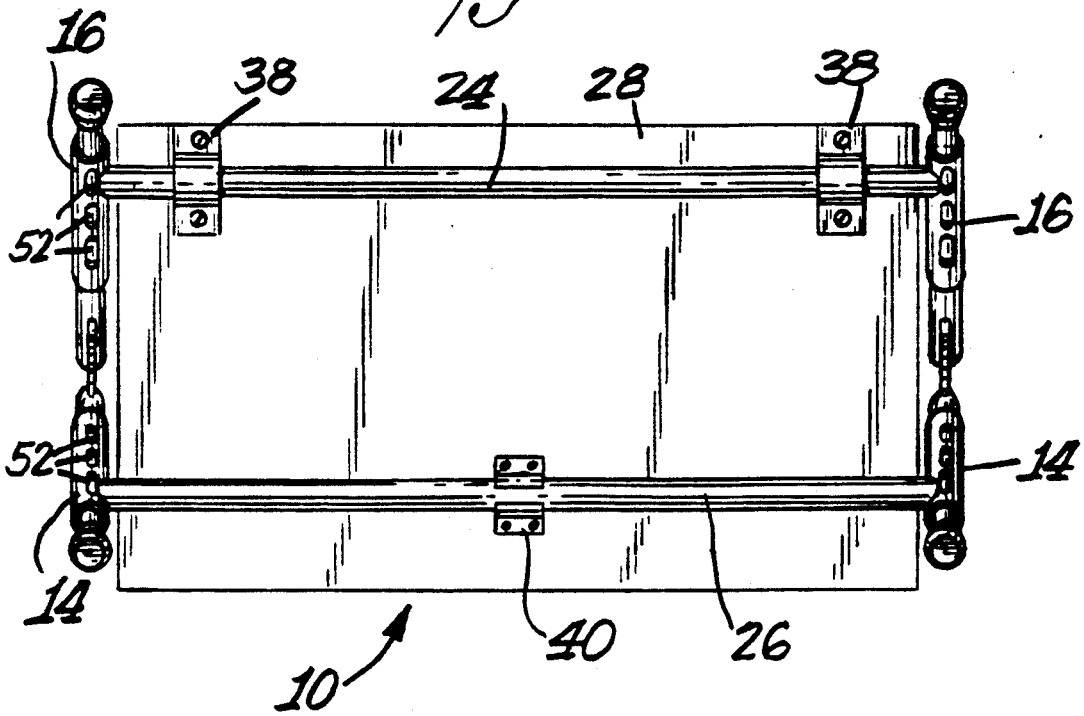
FIG. 5 is a bottom plan view of the device of FIGS. 1–4.

FIGS. 1–5 illustrate a device 10 for simulating climbing in accordance with this invention. As shown therein device 10 includes a pair of side frames 12. Each side frame 12 comprises a pair of upper legs 14,16 of generally circular cross-section. A pair of lower legs 18,20 is telescopically arranged for sliding movement in respective legs 14,16. In this respect, a portion of upper legs 14,16 is of enlarged cross-section to facilitate reception of lower legs 20,22. As best shown in FIG. 5, a pair of cross-bars 24,26 extend across and connect the respective upper legs. For example, cross-bar 24 interconnects upper legs 16,16 while cross-bar 26 interconnects upper legs 14,14. A platform 28 is mounted to the cross-bars to function as a step onto which and from which the user would step during the simulated climbing exercise.

As illustrated, each upper leg includes a series of holes or openings 30 of a size and shape for snugly receiving spring biased pin 32 secured to its respective lower leg. See FIG. 7 which illustrates spring 34 urging pin 32 outwardly. In this manner, the effective height of platform 28 can be controlled by the selective engagement of pin 32 in a respective opening 30 in the device of FIGS. 1–5 or in the openings 52 of the device of FIGS. 7–8. The openings 30 are arranged in a series of four openings with the series of four openings comprising a corresponding opening in each of the four upper legs at the same height so that platform 28 will thereby be in a horizontal condition when the respective pins 32 are engaged in the same series of openings. The maximum height would be achieved by engaging pin 32 in the uppermost holes or openings 30 so that lower legs 20,22 are thereby extended the maximum amount. Conversely, the minimum height of platform 28 would be obtained by engaging pins 32 in the lowermost series of openings 30.

Figure 6:
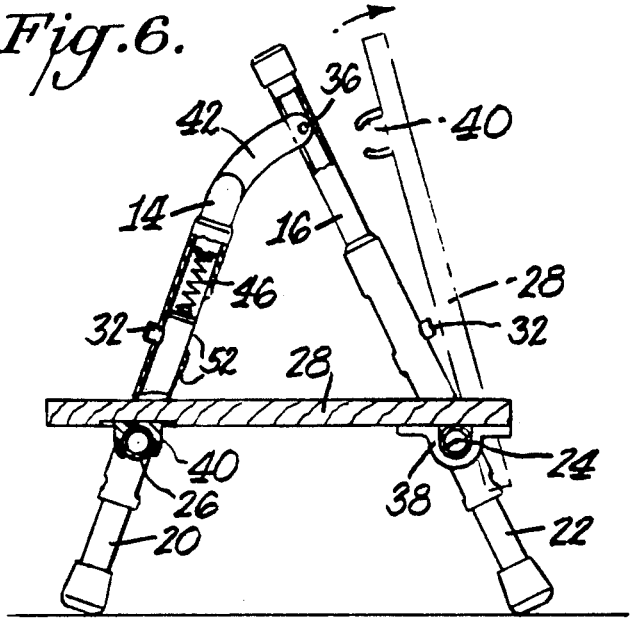
FIG. 6 is a side elevation view, partly in section, of a modified device in accordance with this invention.
Figure 9:
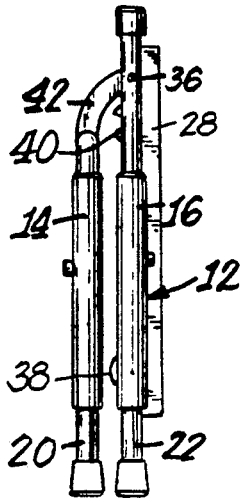
FIG. 9 is a side elevation view of the device of this invention in its collapsed condition.

As illustrated, each upper leg 14 is pivotally connected to its respective upper leg 16 by any suitable pivot device such as pin 36 for purposes later described. Similarly, platform 28 is also pivotally mounted. FIGS. 5–6 for example, show one end of platform 28 to be mounted to cross-bar 24 by means of U-brackets 38 which permanently mount platform 28 to cross-bar 24, yet permit rotational movement about cross-bar 24. Platform 28 is detachably mounted to cross-bar 26 by snapping into bracket 40 which is formed by a pair of curved spring arms, as is shown in the art. Accordingly, during conditions of nonuse device 10 may be stored or transported in a compact condition by snapping platform 28 away from cross-bar 26 and rotating platform 28 about cross-bar 24 since the brackets 38, 40 are permanently secured to platform 28. See FIGS. 6 and 9, platform 28 may thus be raised to a generally vertical condition against upper legs 16. Upper legs 14, in turn, may be pivoted about pins 36 so as to be generally parallel to upper legs 16 by means of the curved connecting pieces 42. This stored condition is illustrated in FIG. 9.

As also illustrated, nonskid caps 44 are detachably mounted to the exposed ends of the various legs.

Figure 7:
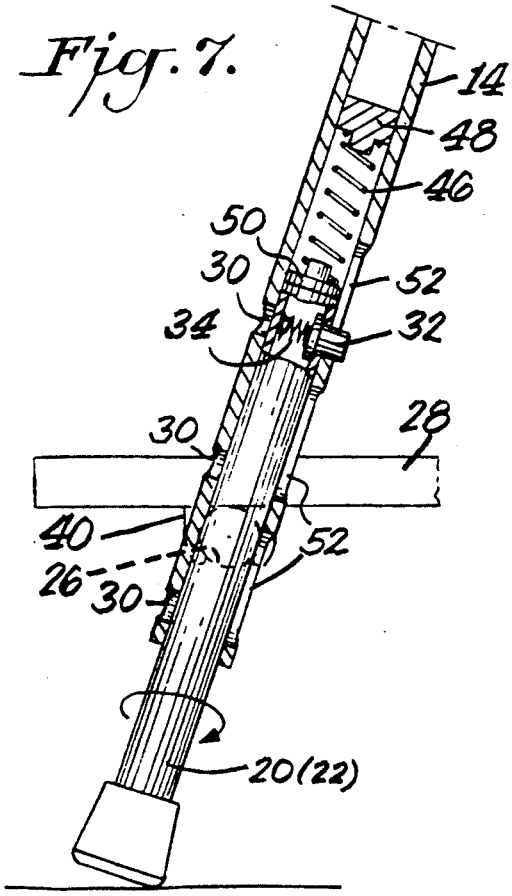
FIGS. 7–8 are side elevation views partly in section of a portion of the device of FIG. 6 in different phases of operation.
Figure 8:
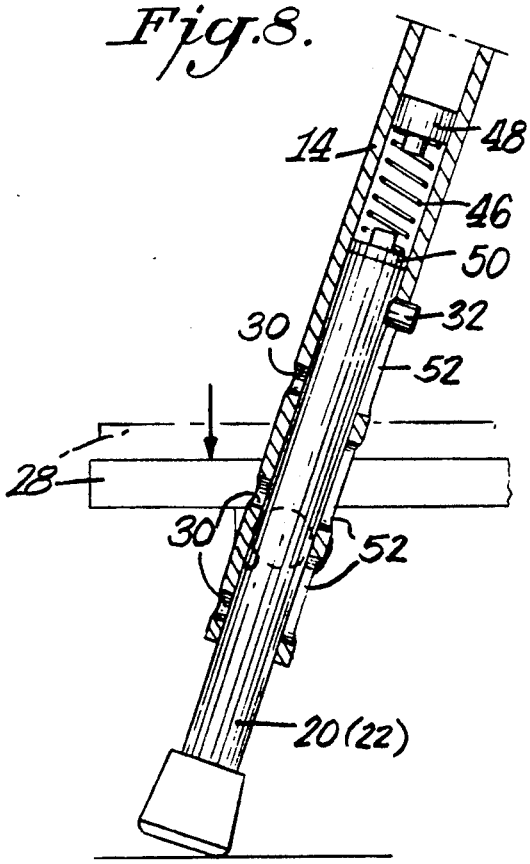
Figure 12:
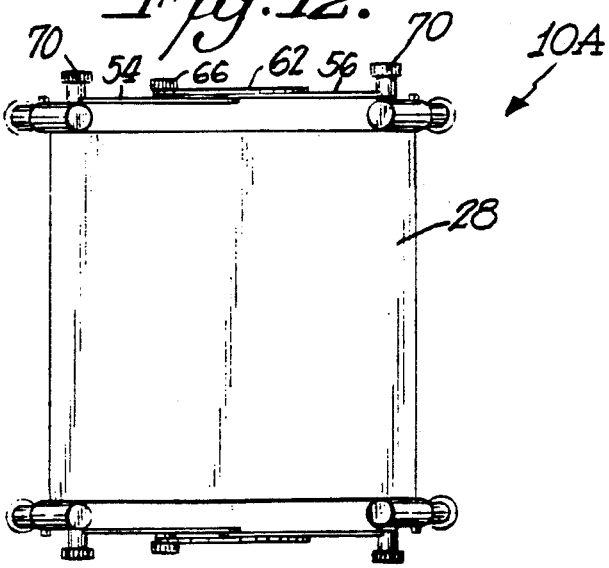
FIG. 12 is a top plan view of the device shown in FIGS. 10–11.

FIGS. 6–8 illustrate a particularly advantageous embodiment of this invention wherein the exercise program incorporates a resilient force which the user overcomes when stepping onto platform 28. This resilient force is achieved by mounting a spring 46 between mounting members 48,50 connected to the respective upper legs and lower legs. The invention provides the user with the alternative of utilizing the resilient force or spring action or not utilizing it. This is accomplished by providing a second set of openings 52 in the form of elongated slots diametrically opposite to the circular holes 30 in each respective upper leg. If the user does not wish to take advantage of the resilient force, lower legs 20,22 would be in the condition shown in FIG. 6 wherein each pin 32 is disposed to be engaged in the small circular holes 30. If the user wishes to make use of the resilient means, the lower leg would be rotated as shown in FIG. 7 by first depressing pin 32 so that it is moved out of hole or opening 30 and retracted completely within the respective upper leg. While in this retracted condition the lower leg may be rotated as illustrated from the condition in FIG. 6 until it is in the position shown in FIGS. 7–8 where it is in line for the engagement in the elongated slots 52. When no force of applied by the user stepping on platform 28 spring 46 urges the lower legs in a position so that the pin 32 is disposed against the upper edge of its respective slot 52. In this manner, platform 28 is in the position shown in phantom in FIG. 8. When the user steps on platform 28 the weight of the user reacts against the resilient force applied by spring 46 to overcome that force and cause platform 28 to move downwardly to the position indicated in solid lines in FIG. 8. The extent of downward movement of platform 28 would be limited by the lower edge of the respective slot 52. In this particular form of exercise, the force needed to overcome the spring 46 could be controlled by proper selection of the particular spring.

Although the invention is illustrated as having the slots 52 diametrically opposite holes 30, the invention may be practiced in other manners where the slots are located a lesser degree away from holes 30.

During non-use, platform 28 is rotated around cross-piece 24 as shown in phantom in FIG. 6. The legs are pivoted toward each other and the device assumes the compact condition of FIG. 9.

In the various devices of FIGS. 1–9 the frame extends above the platform 28. In a variation of those devices the frame would not extend above the platform, whereby the platform would be the uppermost element of the structure. As a result, no obstructions would be provided by the frame. Accordingly, in such practices of the invention, the user could step onto the platform from the side, rather than having to do it from the front or rear. Thus, in such practices of the invention an exercise program could be provided whereby the user steps up from one side and down from the other and if desired, may even take side steps on the platform itself. The effectuation of this variation may be accomplished in various manners, such as illustrated in FIGS. 10–18.

The embodiment of FIGS. 10–13, the device 10A includes the same general structure as in the prior embodiments and accordingly, like reference numerals are used for like parts. In this embodiment, however, the upper legs 14 terminate at the lower surface of platform 28. A hinge mechanism is provided in the form of links 54,56 which are pivoted at upper legs 14 by pivot axles 58. Links 54,56 are also pivotally connected together at pivot pin 60. A radius control track 62 is fixedly mounted at one end 64 to link 56 and slidably mounted by locking member 66 to link 54. Locking member 66 may slide in slot 68 of track 62. Locking member 66 would be tightened when the proper positioning of the legs is achieved. As also illustrated locking members 70 are provided at the ends of upper legs 14 to further lock the hinged device in place.

Figure 13:
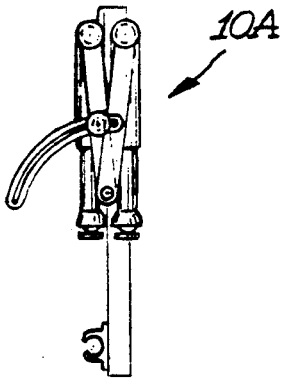
FIG. 13 is a front elevation view of the device shown in FIGS. 10–12 in its collapsed condition.
Figure 10:
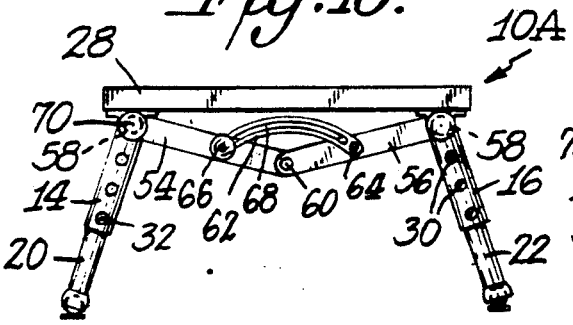
FIG. 10 is a front elevation view of a further embodiment of this invention.
Figure 11:
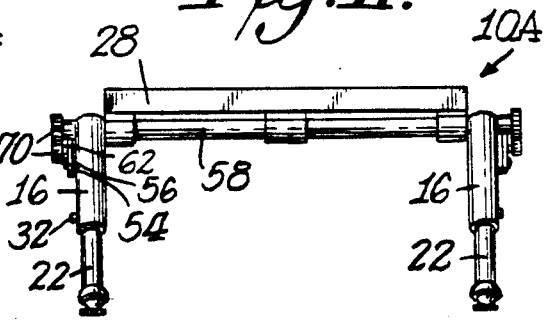
FIG. 11 is a side elevation view of the device shown in FIG. 10.

During conditions of non-use platform 28 would be rotated upwardly as shown in FIG. 13 and the legs and links would be collapsed to the condition shown in FIG. 13 so as to provide a compact unit.

Figure 14:
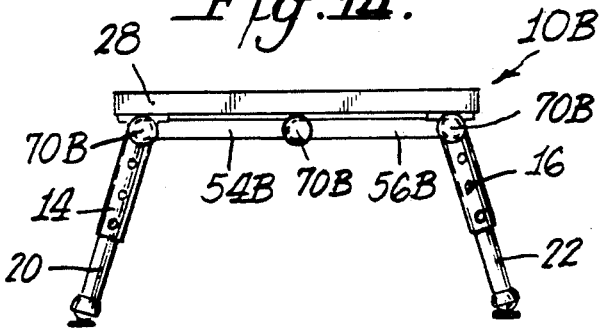
FIG. 14 is a front elevation view of yet another embodiment of this invention.
Figure 15:
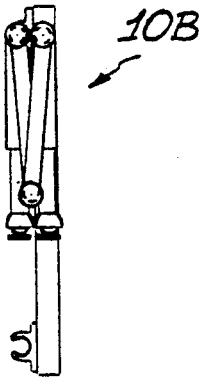
FIG. 15 is a front elevation view of the embodiment of FIG. 14 in its collapsed condition.

FIGS. 14–15 show a variation of the device of FIGS. 10–13. In FIGS. 14–15 device 10B has the links 54B and 56B straight and parallel to platform 28 in the operative condition rather than being hinged downwardly as in device 10A. In this embodiment, a radius control track is not necessary. FIG. 15 shows the compact arrangement during conditions of non-use when platform 28 is rotated parallel to the legs and hinged structure. As in device 10A the hinge folds downwardly in the device of 10B.

Figure 16:
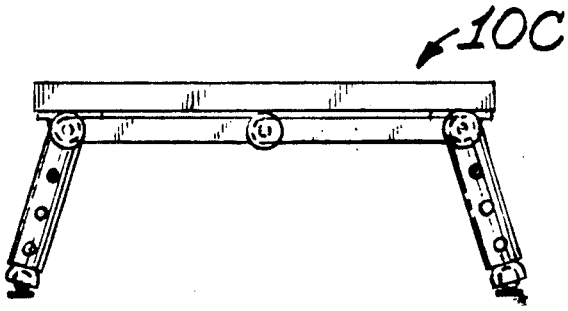
FIG. 16 is a front elevation view of still yet another embodiment of this invention.
Figure 17:
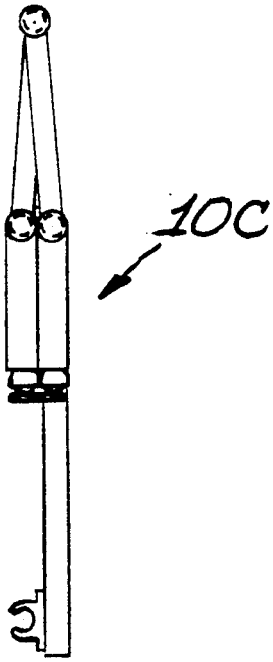
FIG. 17 is a front elevation view of the device shown in FIG. 16 in its collapsed condition.

FIG. 16–17 show yet another variation of this invention wherein the links 54C and 56C of device 10C fold upwardly during the collapsed condition of device 10C.

Figure 18:
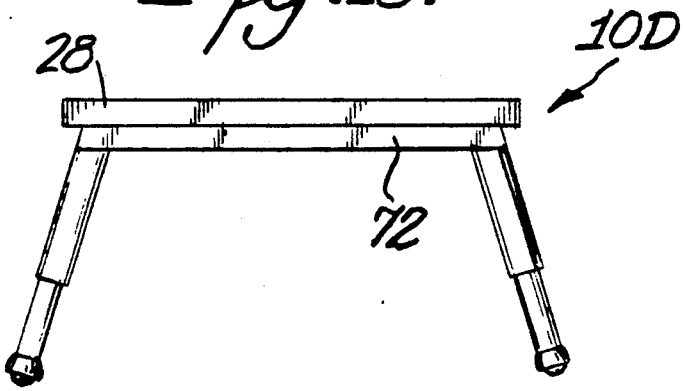
FIG. 18 is a front elevation view of still yet another embodiment of this invention.

FIG. 18 shows yet another variation of this invention wherein the links forming the hinge mechanism are replaced by braces 70. In this arrangement the legs could pivot toward each other to render the device 10D more compact, although it is not necessary that there be any collapsing of device 10D.

As can be appreciated, the invention thereby provides a convenient device which may be stored and transported in a compact condition and may be readily assembled for use to provide the user with a choice of heights for the step or platform in accordance with a particular exercise program. The exercise program may optionally be enhanced by providing a resilient force which the user must overcome when stepping onto the platform.

What is claimed is:

1. A device for simulating climbing comprising a pair of side frames, each of said side frames comprising a pair of upper legs connected together at their upper ends, a lower leg telescoped into each upper leg, a horizontal platform connected to said upper legs, a series of openings in each of said upper legs, each of said openings being arranged in the same plane as a corresponding opening in all of the other of said upper legs to provide a number of sets of openings corresponding to the number of openings in each series, a pin resiliently mounted to each lower leg for selective engagement with a respective opening whereby the height of said platform may be controlled, a pair of cross-pieces, each of said cross-pieces being connected to a respective upper leg in each of said side frames, said platform being mounted to said cross-pieces, said upper legs of each of said side frames being pivotally mounted to each other, and said platform being completely detachably mounted to one of said cross-pieces and pivotally mounted to the other of said cross-pieces whereby said device may be stored in a collapsed condition during periods of nonuse with said platform parallel to and spaced from said other cross-piece.

2. A device for stimulating climbing comprising a pair of side frames, each of said side frames comprising a pair of upper legs connected together at their upper ends, a lower leg telescoped into each upper leg, a horizontal platform connected to said upper legs, a series of openings in each of said upper legs, each of said openings being arranged in the same plane as a corresponding opening in all of the other of said upper legs to provide a number of sets of openings corresponding to the number of openings in each series, a pin resiliently mounted to each lower leg for selective engagement with a respective opening whereby the height of said platform may be controlled, a pair of cross-pieces, each of said cross-pieces being connected to a respective upper leg in each of said side frames, said platform being mounted to said cross-pieces, said upper legs of each of said side frames being pivotally mounted to each other, said platform being completely detachably mounted to one of said cross-pieces and pivotally mounted to the other of said cross-pieces whereby said device may be stored in a collapsed condition during periods of nonuse, said openings being in the form of elongated slots, resilient means reacting between each upper leg and its respective lower leg to urge said platform in an upward direction, the upper edge of each respective slot acting as a stop member for its said pin to limit the upward movement of said platform and the lower edge of each of said slots acting as a stop member to limit the downward movement of said platform when a user steps on said platform to overcome the resilient force of said resilient means.

3. The device of claim 2 wherein said openings further comprise circular openings disposed remote from said slots, and said lower legs being rotatably mounted in said upper legs whereby the user may select either said slots or said circular openings as the openings into which said pins may be engaged.

4. The device of claim 3 wherein said platform is mounted to one of said cross-pieces by means of U-brackets, and said platform being detachably mounted to the other of said cross-pieces by a spring clip.

5. The device of claim 4 including cushioned tips at the exposed ends of said upper and lower legs.

6. The device of claim 5 including a curved connecting member connecting a respective upper leg to the other of said upper legs in each of said side frames.

7. The device of claim 1 wherein said openings are in the form of elongated slots, resilient means reacting between each upper leg and its respective lower leg to urge said platform in an upward direction, the upper edge of each respective slot acting as a stop member for its said pin to limit the upward movement of said platform and the lower edge of each of said slots acting as a stop member to limit the downward movement of said platform when a user steps on said platform to overcome the resilient force of said resilient means.

8. The device of claim 7 wherein said openings further comprise circular openings disposed remote from said slots, and said lower legs being rotatably mounted in said upper legs whereby the user may select either said slots or said circular openings as the openings into which said pins may be engaged.

* * * * *